US005658175A

United States Patent [19]

Muzslay

[11] Patent Number: 5,658,175

[45] Date of Patent: Aug. 19, 1997

[54] ONE-PIECE HOODED SOCKET CONTACT AND METHOD OF PRODUCING SAME

[75] Inventor: Steven Zoltan Muzslay, Huntington Beach, Calif.

[73] Assignee: ITT Corporation, New York, N.Y.

[21] Appl. No.: 539,780

[22] Filed: Oct. 5, 1995

[51] Int. Cl.[6] ..... H01R 13/11

[52] U.S. Cl. ..... 439/852; 439/851; 439/856; 29/874

[58] Field of Search ..... 439/852, 851, 439/853, 856, 842, 843, 861, 862, 885; 29/882, 884, 874

[56] References Cited

U.S. PATENT DOCUMENTS

| | | | |
|---|---|---|---|
| 2,563,760 | 8/1951 | Uline | 439/851 |
| 2,730,692 | 1/1956 | Jongsma | 439/842 |
| 3,083,351 | 3/1963 | Nielsen . | |
| 3,519,799 | 7/1970 | Bange . | |
| 3,538,491 | 11/1970 | Longenecker . | |
| 3,564,487 | 2/1971 | Upstone . | |
| 3,805,220 | 4/1974 | Silbermann | 439/851 |
| 3,853,389 | 12/1974 | Occhipinti . | |
| 3,973,919 | 8/1976 | Simon . | |
| 4,139,256 | 2/1979 | Seidler . | |
| 4,152,042 | 5/1979 | Ostapovitch . | |
| 4,466,684 | 8/1984 | Grant . | |
| 4,834,681 | 5/1989 | Chaillot . | |
| 4,934,967 | 6/1990 | Marks . | |
| 5,131,853 | 7/1992 | Meyer | 439/853 |
| 5,186,663 | 2/1993 | Wymelenberg . | |
| 5,188,545 | 2/1993 | Hass . | |
| 5,281,175 | 1/1994 | Chupak . | |
| 5,288,252 | 2/1994 | Steinhardt . | |
| 5,338,217 | 8/1994 | Saitoh et al. | 439/852 |
| 5,350,321 | 9/1994 | Takenouchi . | |

FOREIGN PATENT DOCUMENTS

| | | | |
|---|---|---|---|
| 541622 | 5/1957 | Canada | 439/851 |
| A-0 183 609 | 6/1986 | European Pat. Off. . | |
| A-26 53 442 | 5/1966 | Germany . | |
| 558199 | 12/1943 | United Kingdom | 439/851 |

OTHER PUBLICATIONS

Patent Abstracts of Japan vol. 013, No. 445 (E–92), 6 Oct. 1989 and JP–A–01 173582 10 Jul. 1989.

Patent Abstracts of Japan vol. 017 No. 310 (E–1380) 14 Jun. 1993 and JP–A–05 029057 5 Feb. 1993.

*Primary Examiner*—David L. Pirlot
*Assistant Examiner*—Tho Dac Ta
*Attorney, Agent, or Firm*—Thomas L. Peterson

[57] ABSTRACT

A one-piece hooded socket contact is disclosed which is formed from a sheet metal blank having spaced trapezoidal-shaped fingers that extend from a forward edge of the blank. The fingers are bent rearwardly and the blank is formed into a cylinder forming the hood of the contact. The fingers extend inwardly toward the center axis of the hood to form the spring beams of the contact. The front portions of the fingers form a lead-in chamfer at the front of the hood.

11 Claims, 3 Drawing Sheets

ONE-PIECE HOODED SOCKET CONTACT AND METHOD OF PRODUCING SAME

BACKGROUND OF THE INVENTION

The present invention relates generally to a socket contact for an electrical connector and, more particularly, to a one-piece hooded socket contact.

Conventional hooded socket contacts for electrical connectors are formed of two pieces, namely, a hood and a contact body. The hood is usually formed of stainless steel and the body is formed of topper, or a copper alloy. The hood is pressed onto the body by complex machines. Such a contact is relatively expensive to produce.

In order to reduce the cost of a hooded socket contact, it is desirable to eliminate the separate hood, and form the contact out of one piece of metal. Such a one-piece hooded socket contact is disclosed in U.S. Pat. No. 4,139,256 to Seidler. Seidler teaches the forming of the spring fingers of the contact by making U-shaped cuts in the sheet metal blank from which the contact is formed, behind the forward edge of the blank. This results in a limited number of spring fingers being available to make electrical engagement with the mating pin contact.

In my copending U.S. application Ser. No. 08/546,179 (Case No. C-CCD-0140), filed Oct. 20, 1995, entitled One-Piece Hooded Socket Contact and Method of Producing Same, assigned to the assignee of the present application, there is disclosed a one-piece hooded socket contact that is formed from a sheet metal blank that is stamped to provide at its forward end a plurality of spring fingers and relatively short lead-in tabs that extend forwardly from the front edge of the blank. The fingers and tabs are bent rearwardly and then the blank is rolled into cylindrical form to form the hood of the contact. The fingers extend inwardly toward the center axis of the hood to form the contact beams for engaging a mating pin contact, and the short lead-in tabs, together with the forward portions of the fingers, provide a lead-in chamfer for the pin contact. Because of the manner in which the fingers and tabs are initially formed in the sheet metal blank, it is relatively easy to roll the sheet metal to form the hood, and maintain the circular shape of the front end of the hood and the lead-in chamfer, and of the spring fingers of the contact, even for a relatively small contact, for example, size 16 (1.5 mm) or size 20 (1 mm) contacts. However, because of the provision of the lead-in tabs in such socket contact, the number of spring fingers that may be incorporated in the contact is limited.

It is the object of the present invention to provide a one-piece hooded socket contact that provides not only a lead-in entry for the mating pin contact, but also permits the incorporation of a large number of spring fingers in the contact for making multiple engagement points with the mating pin contact.

SUMMARY OF THE INVENTION

According to a principal aspect of the present invention, there is provided a one-piece hooded socket contact that is formed from a sheet metal blank that is stamped to provide a plurality of closely-spaced, trapezoidal-shaped fingers that extend forwardly from the front edge of the blank. The fingers are bent rearwardly and then the blank is rolled into cylindrical form to form the hood of the contact. The fingers extend inwardly toward the center axis of the hood to form a generally frustoconical-shaped array of fingers that will engage the mating pin contact. The forward portions of the fingers provide a tapered lead-in entry for the pin contact. By this construction, a large number of fingers are provided for engaging the mating pin contact at multiple points to ensure that no open circuits will occur between the mating contacts even under substantial vibration or shock.

DESCRIPTION OF THE PREFERRED EMBODIMENTS

Figure 1:
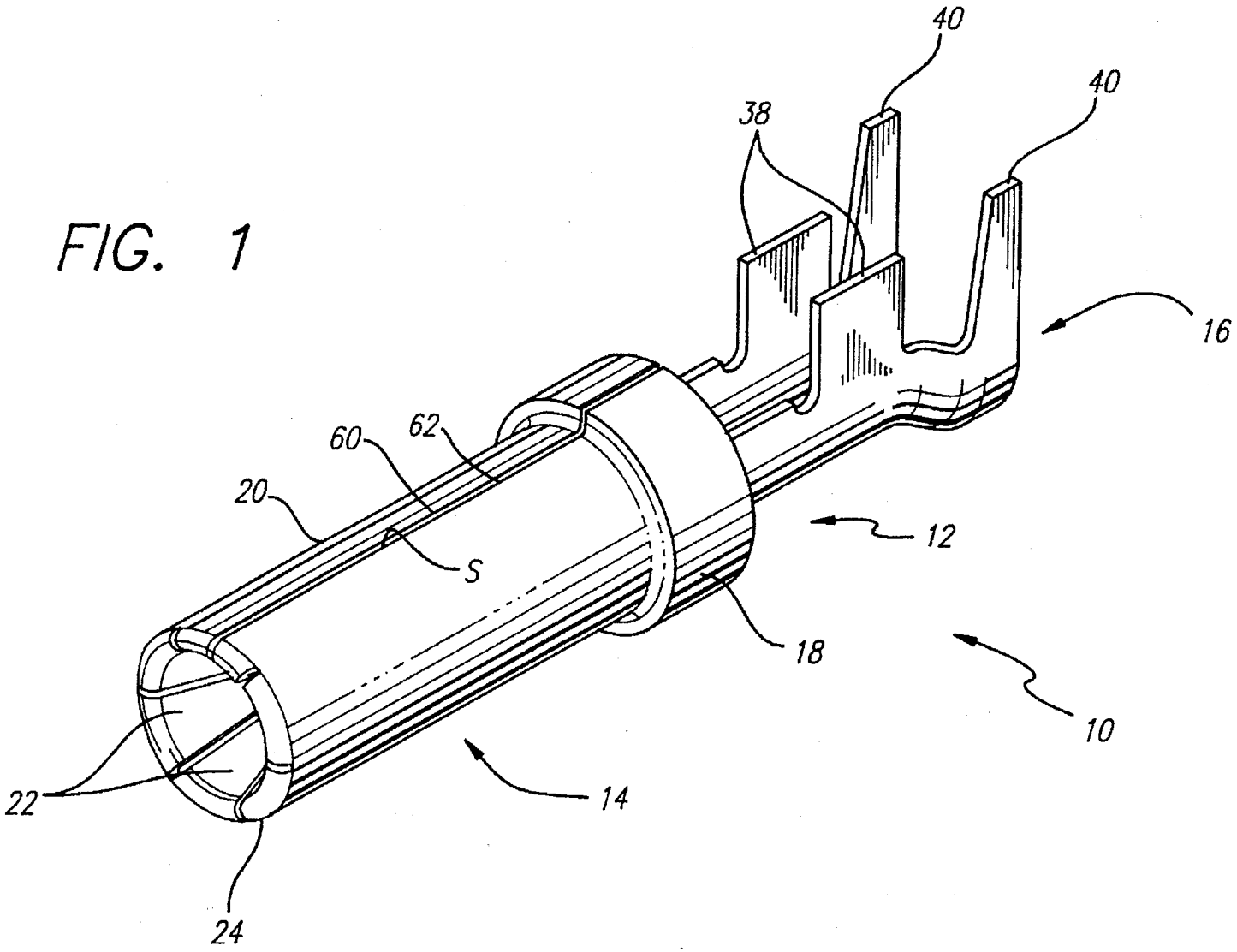
FIG. 1 is an isometric view of the one-piece hooded socket contact of the present invention.
Figure 2:
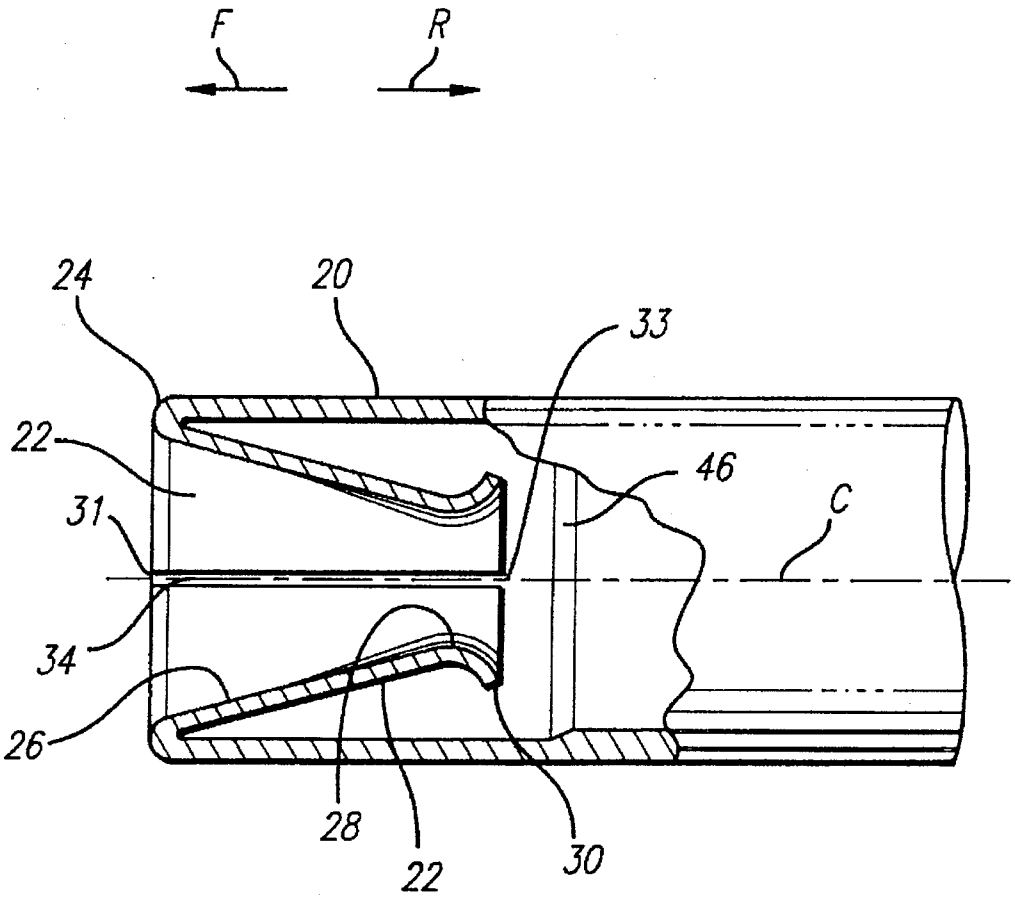
FIG. 2 is an enlarged, partial longitudinal section of the forward mating section of the socket contact illustrated in FIG. 1.
Figure 3:
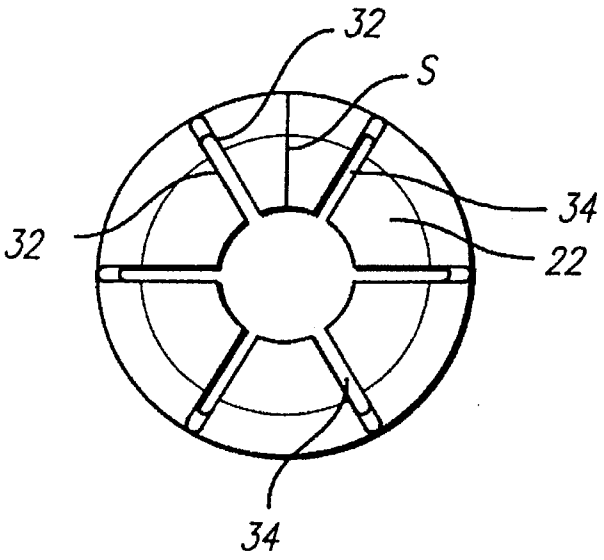
FIG. 3 is a front-end view of the forward mating section of the contact shown in FIG. 2.

Referring now to the drawings in detail, there is illustrated in FIGS. 1–3 the socket contact of the present invention, generally designated 10. The contact comprises a one-piece sheet metal contact body 12 having a forward mating section 14 and a rear wire connection section 16, which is preferably in the form of a crimp barrel. An enlarged collar 18 separates the forward and rear sections of the contact body.

The forward mating section 14 of the contact includes a cylindrical hood 20. A plurality of spring fingers or beams 22 extend rearwardly from the front end 24 of the hood. Each finger has a straight forward portion 26 that extends inwardly from the front end 24 of the hood toward the center axis C of the hood, a curved, inner contacting surface 28 that engages the mating pin contact (not shown) that is inserted into the front of the hood, and a reversely bent rear end 30 that extends outwardly from the contacting surface.

The axis C extends in forward and rearward directions F, R. In accordance with the present invention, each of the spring fingers 22 has a generally trapezoidal configuration. The wider portions of the trapezoidal-shaped fingers are adjacent to the front end 24 of the hood of the contact, while the narrower portions of the fingers are located at the curved contacting surfaces 28 of the fingers. The side edges 32 of adjacent fingers are parallel to each other, and are spaced apart a relatively short distance forming slots 34 between the fingers. Each slot has a width less than the minimum width of each of the fingers. Preferably, the width of each slot is no greater than twice the thickness of a finger 22. Each slot has a second slot end 33 (FIG. 2) at a rear end of a pair of fingers, and has a first slot end 31 opposite its second slot end. Each first slot end 31 lies forward of the second slot end 33, with each first slot end lying at or adjacent to the hood front end 24.

From the foregoing, it is seen that the side edges of each finger converge toward each other in the direction of the contacting surface 28 of the finger. Since the side edges of adjacent fingers are close to each other, the plurality of fingers form a generally frustoconical entry for the mating pin contact leading to the contacting surfaces 28, which ensures a complete insertion of the mating pin contact into the socket contact of the invention, even if the two contacts are originally misaligned.

In the embodiment of the invention illustrated in the drawings, the contact has six spring fingers 22, which provide six points of engagement with the mating pin contact so as to minimize the chance of open circuits occurring between the contacts under high vibration or shock conditions. The number of fingers is, of course, a matter of design choice, and also depends upon the size of the contact, it being understood that the greater number of fingers used enhances the reliability of the electrical engagement made between the mating pin and socket contacts.

The crimp barrel 16 of the contact 10 is of conventional form. It includes a pair of forward crimp tangs 38 and a pair of rear crimp tangs 40 that are crimped upon the wire and the jacket, respectively, of the electrical cable to which the contact is connected.

Figures 4, 5:
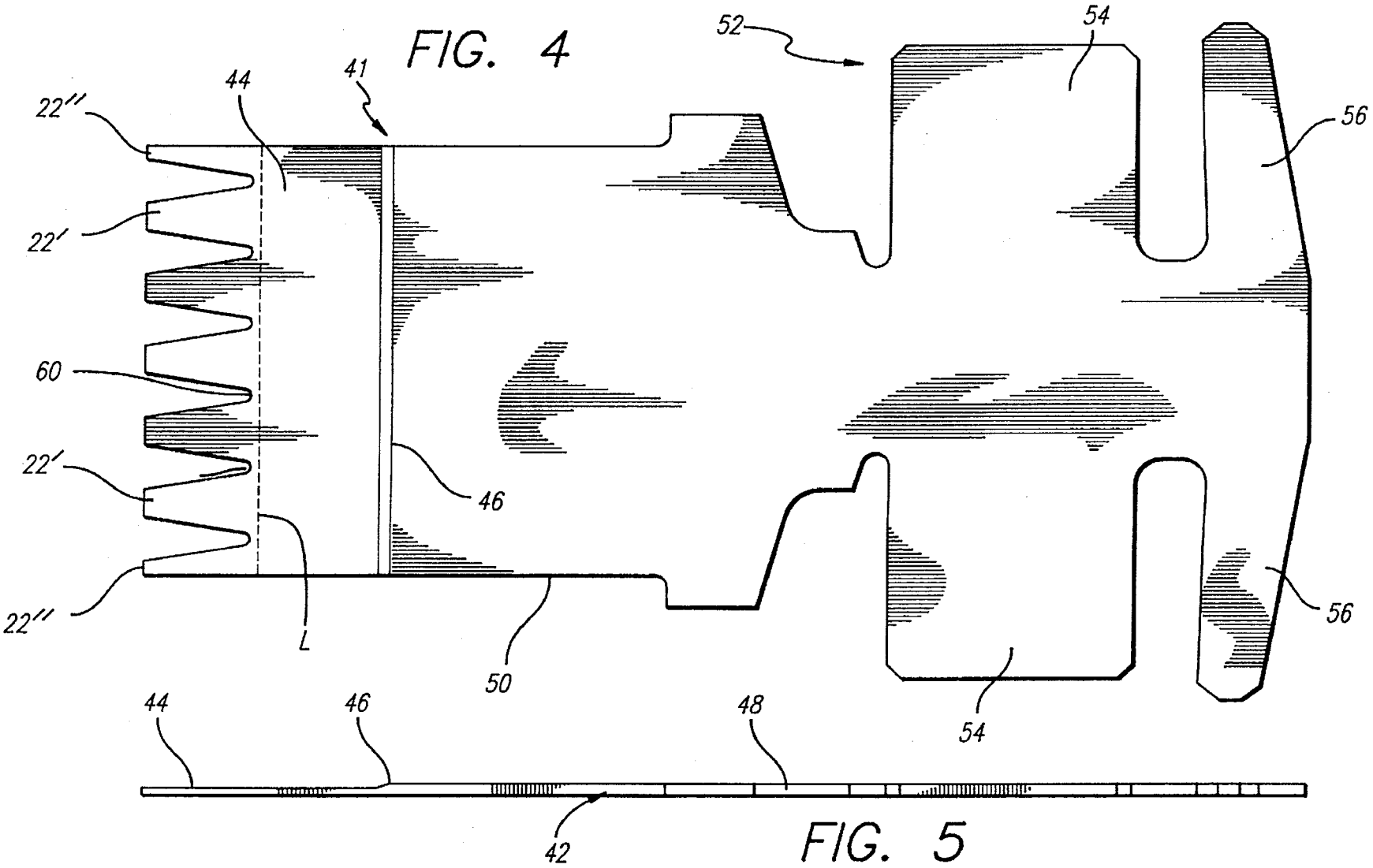
FIG. 4 is a plan view of the sheet metal blank from which the contact shown in FIGS. 1–3 is formed.
FIG. 5 is a side view of the sheet metal stock from which the blank shown in FIG. 4 is formed.

Reference is now made to FIG. 4 of the drawings, which shows the sheet metal blank 41 from which the one-piece hooded socket contact 10 of the invention is made. Preferably, the blank 41 is formed from sheet metal stock 42 as shown in FIG. 5 that has a forward region 44 in front of a dividing line 46, which has a thickness less than the thickness of the rear region 48 of the stock. The sheet stock is a generally malleable metal, such as quarter hard copper or beryllium copper alloy. The forward region 44 of the stock is coined down to a smaller thickness as shown in FIG. 5. The coining operation work-hardens the metal causing it to become spring-tempered, and hence more resilient than the rear region 48 of the stock. The rear region is malleable and, therefore, is suitable for crimping operations when formed into a crimp barrel. By way of example only, for a size 16 contact, a quarter hard copper alloy of 0.010 inch thickness may be coined down to a thickness of 0.006 inch at the forward region 44, so that the forward region is relatively resilient, and easier to form and roll.

Alternatively, the forward region 44 of the stock may be made of a separate spring-tempered metal sheet which is bonded to the rear region 48 of a more malleable metal sheet, such as by laser welding.

The sheet metal blank 41 shown in FIG. 4 is stamped from the sheet stock 42 shown in FIG. 5. The blank 40 includes a front part 50, that includes the dividing line 46 separating the tempered and malleable sections of the metal sheet, and a rear part 52. The front part has a generally rectangular configuration, while the rear part includes laterally-extending wings 54 and 56 which are bent up during the forming operation of the contact to provide the crimp tangs 38 and 40, respectively, of the finished contact, as seen in FIG. 1.

The stamped sheet metal blank or piece of sheet metal 41 shown in FIG. 4 is formed with five full fingers 22', and two half-fingers 22" at the outer edge of the blank. The fingers extend forwardly from the front edge 60 of the front part 50 of the blank. The fingers of the blank 40 correspond to the spring fingers 22 of the finished contact shown in FIGS. 1–3.

To form the socket contact 10 of the invention, first the fingers 22' and half-fingers 22" of the sheet metal blank 40 are formed to provide the curved contacting surface 28 and the rear end 30 of the finished spring fingers 22 as seen in FIG. 2, and then the forward portion of the blank, including the fingers 22' and 22", is bent upwardly at the bend line L so that the fingers extend rearwardly at an acute angle. As seen in FIG. 4, the bend line L is spaced a short distance behind the front edge 60 of the blank. Thereafter, the front part 50 of the blank is rolled upwardly into a cylindrical configuration to form the hood 20. During the rolling operation, the fingers 22" and 22" become arcuately shaped and extend inwardly toward the center axis of the hood of the contact. Simultaneously with such rolling operation, or in a separate operation, the wings 54 and 56 at the rear part 52 of the blank are formed upwardly to provide the crimp barrel 16 of the contact. The bend that is formed along the line L of the sheet metal blank provides a smooth, curved, continuous lead-in surface at the front of the hood of the contact.

Since the forward region of the sheet metal blank from which the contact 10 is formed is a spring-tempered metal of reduced thickness, it is relatively easy to form and roll the metal to produce the forward mating section of the contact, and the spring fingers 22 will have substantial resiliency for providing good electrical engagement with the mating pin contact.

Preferably first and second edges 60, 62 at the seam S of the rolled contact, shown in FIGS. 1 and 3, is welded or brazed to form a weld or braze joint, to avoid opening of the seam when a pin contact is inserted into the socket contact 10.

From the foregoing, it is seen that by the present invention there is provided a method for producing a one-piece hooded socket contact which is particularly adaptable for contacts of relatively small size, where a large number of closely spaced spring fingers are employed to provide reliable electrical engagement with the mating pin contact. Furthermore, the socket contact is simple in construction, and relatively inexpensive to manufacture.

Although particular embodiments of the invention have been described and illustrated herein, it is recognized that modifications and variations to the invention may readily occur to those skilled in the art and, consequently, it is intended that the claims be interpreted to cover such modifications and equivalents.

What is claimed is:

1. A one-piece hooded socket contact comprising: a sheet metal contact body having a forward mating section and a rear section;

said mating section comprising a generally cylindrical hood having an axis and having a front end and a plurality of integral generally trapezoidal-shaped spring fingers, said fingers extending rearwardly from said front end and inwardly toward said axis of said cylindrical hood and with said fingers having rear ends, said rear ends being formed of a free end of said sheet metal contact body; and said fingers being separated by slots each having a width less than the width of each of said fingers, with said slots having second slot ends at said finger rear ends and having opposite first slot ends lying forward of said second slot ends, with said first slot ends lying adjacent to said front end of said generally cylindrical hood.

2. A socket contact as set forth in claim 1 wherein:

said sheet metal of said body is bent into a cylinder with opposite sheet metal edges that extend parallel to each other and that lie adjacent to each other at said generally cylindrical hood;

said edges are joined by a joint that consists of a weld joint or a braze joint.

3. A socket contact as set forth in claim 1 wherein:

said rear section of said contact body is constructed for wire crimping, and said hood and said fingers are formed of a first piece of a first metal, and said rear section is formed of a second piece of a second metal that is bonded to said first piece.

4. A socket contact as set forth in claim 1 wherein:

adjacent fingers of said plurality of fingers have side edges forming said slots, said side edges of said adjacent fingers being parallel to each other.

5. A socket contact as set forth in claim 1 wherein:

said fingers are formed of metal of predetermined thickness, and the width of each of said slots is no greater than twice said thickness of said metal of said fingers.

6. A method of producing a one-piece hooded socket contact comprising a contact body having a forward mating section and a rear connection section, said mating section comprising a generally cylindrical hood having a front end, and a plurality of spring fingers, comprising:

providing a sheet metal blank having a front part of forming said forward mating section and a rear part configured to form said connection section, said front part having a front end and having a remainder lying rearward of said front end;

forming said front end with forward-extending, closely spaced fingers of generally trapezoidal configuration, including removing material lying between said fingers;

bending said fingers upwardly and rearwardly with said fingers extending at an acute angle relative to said remainder; and rolling said front part of said blank into a cylindrical configuration with an axis to form said hood with said fingers extending inwardly toward said axis.

7. A method of producing a socket contact as set forth in claim 6 wherein:

said front part of said blank, including said fingers, is coined to a reduced thickness to temper the metal in such region.

8. A method of producing a socket contact as set forth in claim 6 wherein:

said connection section is constructed to crimp to a wire;

said front part of said blank is formed of a separate piece of metal having a resiliency greater than that of said rear part; and said separate piece of metal is bonded to the remainder of said blank.

9. A one-piece hooded socket contact, comprising:

a piece of sheet metal that has a thickness and that has a forward mating section and a rear section;

said mating section being bent to form a generally cylindrical hood that has an outer hood surface, a hood front end, and an axis extending in forward and rearward directions;

said sheet metal forms a bend at said hood front end to form a portion of sheet metal that lies within said hood and that extends from said hood front end, primarily rearwardly and toward said axis, said piece of sheet metal having a plurality of slots that divide said portion into a plurality of fingers, with said fingers having side edges that are parallel and spaced by no more than about twice the thickness of said sheet metal.

10. The socket contact described in claim 9 wherein:

said fingers have rear ends and said slots have second slot ends at said finger rear ends and have first slot ends lying opposite said finger rear ends, with said first slot ends lying at said hood front end.

11. The socket contact described in claim 9 wherein:

said sheet metal is bent to form said generally cylindrical hood, with said sheet metal having opposite edges lying adjacent to each other and extending primarily parallel to said axis along said hood, with said opposite edges joined by a joint that consists of a weld joint or a brazed joint.

* * * * *